United States Patent [19]

Fehlmann et al.

[11] Patent Number: 4,873,956

[45] Date of Patent: Oct. 17, 1989

[54] FUEL INJECTION PUMP FOR INTERNAL COMBUSTION ENGINES

[75] Inventors: Wolfgang Fehlmann, Stuttgart; Gerald Hofer, Bad Aibling; Dieter Junger, Stuttgart; Anton Karle, Leonberg; Helmut Laufer, Gerlingen, all of Fed. Rep. of Germany

[73] Assignee: Robert Bosch GmbH, Stuttgart, Fed. Rep. of Germany

[21] Appl. No.: 134,265

[22] Filed: Dec. 17, 1987

[30] Foreign Application Priority Data

Feb. 13, 1987 [DE] Fed. Rep. of Germany ..... 3704578

[51] Int. Cl.[4] ..... F02M 39/00

[52] U.S. Cl. ..... 123/357; 123/503; 123/449

[58] Field of Search ..... 123/503, 449, 357, 358, 123/359

[56] References Cited

U.S. PATENT DOCUMENTS 4,345,563 8/1982 Eheim ..... 123/357
4,423,485 12/1983 Sami ..... 123/357
4,465,044 8/1984 Yasuhara ..... 123/357
4,495,915 1/1985 Shinoda ..... 123/357
4,543,914 10/1985 Harris ..... 123/357

FOREIGN PATENT DOCUMENTS 0146027 11/1981 Japan ..... 123/357

*Primary Examiner*—Carl Stuart Miller
*Attorney, Agent, or Firm*—Edwin E. Greigg

[57] ABSTRACT

A fuel injection pump for internal combustion engines having an electromagnetic final control element, which in order to adjust the end or onset of injection engages a control slide, located in the pump interior. Via a control shaft, the final control element chamber is hermetically sealed off from the pump interior in order to keep water contained in the fuel from reaching current-carrying parts of the final control element. As a result, fluid communication exists only via the bearing gap of the slide bearing of the control shaft and the bearing gap functions as a throttle. The throttle forms a water separator, which further reduces the concentration of water in the already small quantity of fuel reaching the final control element chamber through the throttle.

2 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines.

Fuel, especially Diesel fuel, usually contains a variably large amount of water. Normally this water is filtered out by a water trap provided in the fuel filter. If the water filter is not well maintained, however, water still gets into the fuel injection pump.

In a fuel injection pump of the generic type referred to above, known from German Offenlegungsschrift 29 29 176, the entire overflow quantity of approximately 30 liters per hour flows out of the pump interior via a fluid-carrying opening into the chamber of the final control element, and from there it flows back via a fuel return line into the fuel tank, which is subject to atmospheric pressure. Thus water can also get into the current-carrying parts of the final control element, and if it remains there for some time it will cause them to corrode and be destroyed.

OBJECT AND SUMMARY OF THE INVENTION

The fuel injection pump according to the invention has an advantage that because the liquid-carrying opening between the pump interior and the chamber of the final control element is reduced to a very small throttle, only a few micrometers in cross section, only a very small quantity of fuel can flow into the final control element chamber. Thus, not only is the amount of water flowing into the final control element chamber reduced along with the reduction in fuel quantity, but an additional effect is attaind as well since the throttle acts as a water separator and further reduces the percentage of water in the fuel reaching the final control element chamber.

If in accordance with an exemplary embodiment of the invention, the throttle is embodied by the bearing gap of a control shaft supported in a slide bearing, the control shaft representing the actuating part engaging the quantity adjusting device, then it is at the same time possible to avoid sealing off the control shaft in the slide bearing, thereby also avoiding the disadvantage that liquid seals are the source of severe friction on the rotating control shaft and so impair the function of the final control element considerably. With a bearing play of approximately 4 to 7 $\mu$m, which is adequate for satisfactory functioning of the final control element, only approximately 10% of the water contained in the fuel can flow through. If the concentration of water in the pump interior is 1%, then this means a remaining concentration of water, in the final control element chamber of only 0.1%.

If a pressure of approximately 0.5 bar is maintained in the final control element chamber, which can be effected by means of a pressure maintenance valve in the relief line as in the exemplary embodiment, then at the existing differential pressure between the pressure of approximately 3 to 8 bar prevailing in the pump interior and the pressure in th4 final control element chamber, the aforementioned bearing play has the effect of an average fuel quantity of only approximately 30 $cm^3/h$. At a water concentration of 0.1%, accordingly only 30 $mm^3/h$ of water reach the final control element chamber. Because of they very low turbulence, this extremely small quantity of water settles on the bottom of the final control element chamber. There, the water cannot come into contact with current-carrying components and thus cannot cause any damage.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 2:
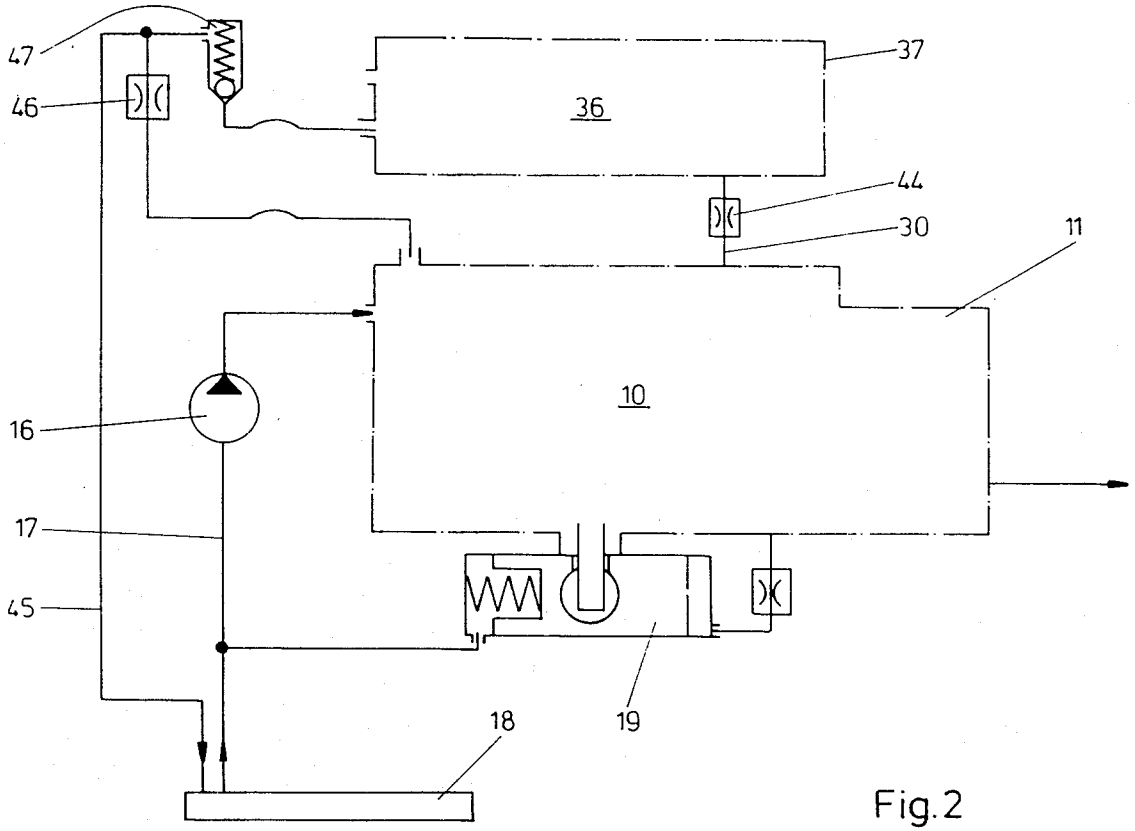
FIG. 2 is a schematic representation of the injection pump of FIG. 1 along with its fuel connection lines leading to a fuel tank.

In the distributor type of fuel injection pump for an internal combustion engine, shown in the drawing, a pump interior 10 is enclosed by a pump housing 11. A pump cylinder 12 is inserted into the pump housing 11, and a distributor piston 13 is guided in the pump cylinder 12. The distributor piston 13 is set into rotary and reciprocating motion by a cam drive 14 and a drive shaft 15. The drive shaft 15 at the same time drives a feed pump 16, which via a feed line 17 (FIG. 2) pumps fuel out of a fuel tank 18 into the pump interior 10. The pressure in the pump interior 10 is determined by a pressure control valve, not shown, which controls the pressure as a function of rpm, so that the pressure increases with increasing rpm. This pressure variation is converted by a hydraulic injection adjuster into a rotary movement of a roller ring 20 of the cam drive, 14, thereby adjusting the injection onset of the fuel injection pump toward "early" as the rpm increases.

Figure 1:
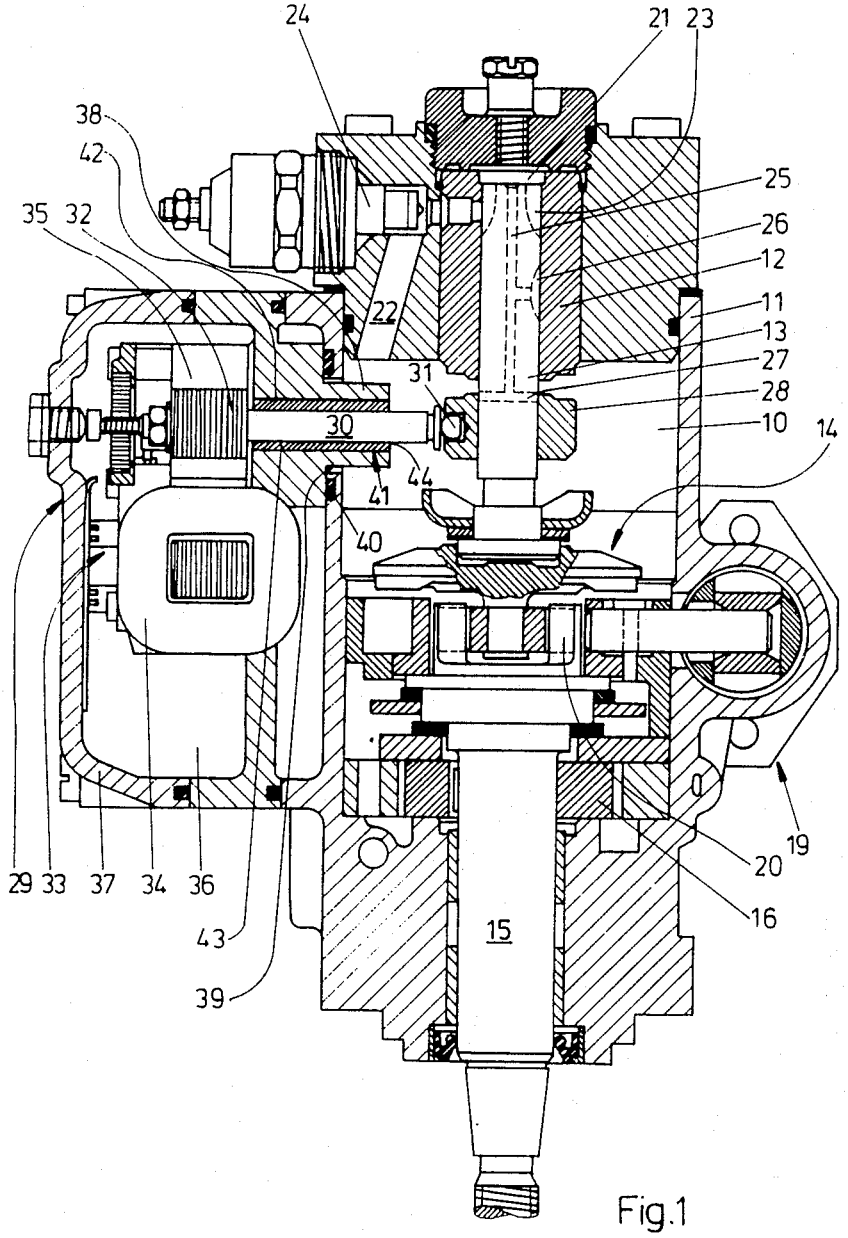
FIG. 1 is a longitudinal section taken through a distributor-type fuel injection pump.

On its face end, the distributor piston 13 defines a pump work chamber or high-pressure chamber 21 in the pump cylinder 12; during the downward stroke of the distributor piston 13, this chamber 21 is supplied with fuel from the pump interior 10 via an intake conduit 22 and a longitudinal groove 23 disposed in the jacket face of the distributor piston 13. The intake conduit 22 is controlled by means of a magnetic valve 24, which is closed when it is without current; in FIG. 1, the magnetic valve 23 is shown in its operating position. During the compression stroke of the distributor piston 13, that is, during its upward movement, the fuel then flows out of the high-pressure chamber 21 via a central bore 25 to a distributor groove 26, which in successive compression strokes sequentially opens pressure lines leading to different injection nozzles. The central bore 25 discharges into a radial control bore 27, which emerges from a control slide 28 after executing a predetermined stroke and thereby effects communication between the high-pressure chamber 21 and the pump interior 10, as a result of which the fuel injection by the distributor piston 13 is terminated. The control slide 28 thus defines the instantaneous injection quantity and acts as a quantity adjusting device.

The control slide 28 is mounted for axial displacement on the distributor piston 13, in fact on the section of the piston that extends within the pump interior 10. For the axial displacement of the control slide 28, an electromagnetic final control element 29 is provided, which engages the control slide 28 via a control shaft 30 and an eccentric element 31 disposed on the face end of the control shaft 30. The control shaft 30 is rigidly connected to the armature 32 of a rotary magnet 33, so that a rotation of the armature 32 via the eccentric element 31 is converted into a displacement of the control slide 38. The rotary magnet 33 is excited via a coil 34 on a U-shaped core 35.

The electromagnetic final control element 29 is disposed in a final control element chamber 36 enclosed by a final control element housing 37 flanged to the pump housing 11. The final control element chamber 36 is sealed off from the pump interior 10 in a liquid-tight manner. A bearing support 38 of the final control element housing 37 protrudes into the pump interior 10 through a bore 39 in the pump housing 11. The bore 39 is sealed off from the bearing support 38 by a sealing ring 40. The bearing support 38 contains a slide bearing 41 for the control shaft 30 and to this end has an axial bore 42 in which a slide bushing 43 is retained. The control shaft 30 is guided with radial play all the way through the slide bushing 43, forming a bearing gap 44 of annular cross section between the control shaft 30 and the slide bushing 43. This bearing gap 44 forms a throttle between the pump interior 10 and the final control element 29. In the pump interior 10, the fuel is at a feed pressure of approximately 3 to 8 bar. In the final control element chamber 36, which is connected via a pressure maintenance valve 47 to a fuel return line 45 (see FIG. 2) leading to the fuel tank, a pressure of approximately 0.5 bar prevails. Through the throttle formed by the bearing gap 44, a fuel quantity that is dependent on the pressure difference between the pump interior 10 and the final control element chamber 36 flows into the final control element chamber 36. Since the radial width of the bearing gap 44 is approximately 2 to 3 $\mu$m, the quantity of fuel flowing through the bearing gap 44 to reach the final control element chamber 36 is relatively small, amounting to approximately 30 $cm^3/h$. In this relatively small fuel quantity, the water concentration is only approximately 10% of the water concentration in the fuel located in the pump interior 10. The relatively small proportion of water settles on the bottom of the final control element chamber 36, because of the very low turbulence, and there it cannot come into contact with current-carrying parts of the electromagnetic final control element 29. The overflow quantity of approximately 30 liters per hour that rises in the control of the feed pressure in the pump interior 10 is returned to the fuel tank 18 again via an overflow throttle 46 and the fuel return line 45.

The foregoing relates to an exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a pump housing, a pump interior enclosed by said pump housing, said pump interior adapted to receive fuel under pressure, a pump piston that defines a pump work chamber for receiving fuel under pressure during an intake stroke of said pump piston, a final control element housing secured to said pump housing, a quantity adjusting device for controlling the fuel injection quantity pumped at high pressure by said pump piston, an actuating part having a first end connected to said quantity adjusting device for adjusting said quantity adjusting device, said actuating part including a control shaft (30) of constant diameter supported in a slide bearing (41) supported in a wall of said final control element housing, said actuating part including a second end being actuatable by an electrical final control element being disposed in a final control element chamber in said final control element housing, said final control element chamber communicating through at least one liquid-carrying opening with the pump interior and through a relief line (45) with a relief chamber (18), said at least one liquid-carrying opening embodied as a throttle gap (44) of constant cross section, and said throttle gap (44) of constant cross section embodied by a bearing gap of said slide bearing (41).

2. A fuel injection pump as defined by claim 1, which includes a pressure maintenance valve (47) disposed in said relief line said pressure maintenance valve opening in a relief direction leading to said relief chamber (18).

* * * * *